United States Patent [19]

Roosa

[11] Patent Number: 4,567,872

[45] Date of Patent: Feb. 4, 1986

[54] UNIT FUEL INJECTOR AND SYSTEM THEREFOR

[75] Inventor: Vernon D. Roosa, West Hartford, Conn.

[73] Assignee: Stanadyne, Inc., Windsor, Conn.

[21] Appl. No.: 535,829

[22] Filed: Sep. 26, 1983

[51] Int. Cl.[4] ..... F02M 37/04

[52] U.S. Cl. ..... 123/470; 123/450; 123/508; 123/446; 239/88

[58] Field of Search ..... 123/508, 509, 470, 446, 123/501, 450; 239/88, 95

[56] References Cited

U.S. PATENT DOCUMENTS

| | | | |
|---|---|---|---|
| 1,863,232 | 6/1932 | Woolson | 123/470 |
| 1,938,948 | 12/1933 | Widmann | 239/88 |
| 1,949,470 | 3/1934 | Hesselman | 123/508 |
| 2,053,311 | 9/1936 | Amery | 239/88 |
| 2,354,403 | 7/1944 | Reggio | 123/470 |
| 2,852,011 | 9/1958 | Pringham | 123/450 |
| 3,625,191 | 12/1971 | Harding | 123/450 |
| 3,913,548 | 10/1975 | Wilson | 123/501 |
| 4,164,923 | 8/1979 | Kimata et al. | 123/450 |
| 4,306,528 | 12/1981 | Straubel et al. | 123/501 |
| 4,378,775 | 4/1983 | Straubel et al. | 123/446 |

FOREIGN PATENT DOCUMENTS

| | | | |
|---|---|---|---|
| 133350 | 5/1933 | Austria | 123/446 |

*Primary Examiner*—Magdalen Y. C. Moy

*Attorney, Agent, or Firm*—Prutzman, Kalb, Chilton & Alix

[57] ABSTRACT

A cam shaft operated fuel injector having an elongated fuel injection nozzle, a linear pumping plunger with an axis normal to the axis of the nozzle in two embodiments and parallel to the axis of the nozzle in three embodiments and ball check valve means for the pumping plunger arranged to minimize the high pressure chamber volume and to simplify the design and assembly of the unit injector. One embodiment employs an inlet metering valve, another embodiment employs end of injection spill control and another embodiment is adapted for receiving a metered charge of fuel from a separate low pressure distributor pump having a governor controlled linear metering valve and a sleeve like distributor rotor surrounding the metering valve.

43 Claims, 10 Drawing Figures

UNIT FUEL INJECTOR AND SYSTEM THEREFOR

BACKGROUND OF THE INVENTION

This invention relates to a unit fuel injector and a system therefor employed in association with a cylinder of an internal combustion engine. More particularly, this invention relates to a unit fuel injector and system therefor wherein a pump plunger and an injection valve are mounted in separate bores of a single housing adapted for mounting to the engine.

Many conventional fuel injection systems for internal combustion engines employ a single fuel injection pump for supplying fuel under high pressure to fuel injectors, each of which is associated with a cylinder of the engine. While many such fuel injection systems are highly efficient and provide a high level of performance over a wide range of operating conditions, a number of deficiencies are inherent in such systems. For example, the fuel line volume between the injection pump and the several injectors may vary resulting in a variation in the timing of the delivery of pressurized fuel to the different nozzles, particularly at relatively high speeds. Moreover, the high pressure fuel lines connecting the high pressure pumping chamber of the injection pump to each of the several injectors require fittings which are required to withstand high pressure. Such fittings are potential sources for the leakage of the pressurized fuel.

Unit fuel injectors wherein the high-pressure fuel is generated within or proximate the injector rather than at a remote high-pressure injection pump have been employed to overcome the previously described deficiencies and to incorporate other desired features. Prior art unit fuel injectors have employed a pump plunger which is coaxially mounted with respect to the injection plunger. However, substantial headroom is required by many such injectors in order to connect the rocker arm or actuating means of the engine with the end of the pumping plunger for actuation of the unit fuel injector. In addition to the difficulties of conforming to the headroom constraints of the engine, prior art unit fuel injectors generally have not incorporated efficient timing means to control the timing of injection of the fuel charge. The stroke control and timing control can be critical features at high engine speeds where relatively small quantities of fuel are required for each pumping stroke.

BRIEF SUMMARY OF THE INVENTION

Briefly stated, the invention in a preferred form is directed to a unit fuel injector for an internal combustion engine comprising an injection nozzle received in a bore of a cylinder head of the engine. The nozzle includes an injection valve and a discharge tip to inject pressurized fuel into the cylinder. The injection nozzle is received in an injector housing which is mounted to the engine. A fuel injection pump means is also mounted in the injector housing. The pump means includes a pump plunger actuable by the cam shaft of the engine. The plunger is reciprocative in a pump chamber in the housing which chamber communicates with the injection nozzle to supply pressurized fuel. A fuel inlet means is also disposed in the injector housing. The fuel inlet means includes a fuel inlet passage which communicates with the pump chamber to supply fuel under low pressure to the pump chamber.

The plunger reciprocates in the pump chamber by means of a pushrod which bears against an actuating arm. A cam member mounted on the cam shaft of the engine translates the contour of the cam member into pivotal movement of the actuating arm. Means are provided for limiting the stroke of the plunger and for controlling the timing of the actuation of the pushrod by the actuating arm.

An inlet metering means for controlling the quantity of fuel in the pump chamber may also be provided. In one form, the metering means comprises a metering valve in the fuel inlet means. In another embodiment of the invention, the metering means comprises a spill passage in the pump plunger. Fuel return means may also be provided in the unit fuel injector to return fuel to the fuel inlet or the fuel reservoir of the associated engine or to return fuel leakage to the inlet of the injector.

In one form of the invention, the unit fuel injector housing includes three bores receiving an injection nozzle, a fuel injection pump means, and a fuel inlet means. The bores are substantially parallel and the bores communicate by a pair of transverse aligned passages each having a one-way check valve. In another embodiment of the invention, the bores are disposed at right angles. One of the bores may be transverse and offset from the other bores.

A unit fuel injector may also be employed in combination with a distributor/governor unit for metering fuel and transferring the fuel under low pressure from the fuel reservoir of the associated engine to the fuel inlet of a unit fuel injector. In a preferred form, a distributor/governor unit comprises a distributor housing having a plurality of angularly spaced radial transfer passages. A distributor rotor is adapted to be driven by the engine for rotation in the housing. The rotor has a radial inlet passage and a radial distributor passage which aligns with the transfer passages. The distributor means is connected with a governor means to control the quantity of fuel to the transfer passages. A transfer pump is rotatable with the rotor to transfer the fuel under low pressure from a fuel reservoir of the engine to a transfer passage. A spring biased axially shiftable metering valve is positioned interior of the rotor. The metering valve has a valve chamber alignable with the inlet and distributor passages, and the valve is axially shiftable by the governor means to vary the quantity of fuel delivered to the transfer passages.

The governor means in a preferred form comprises a flyweight means rotatable with the rotor and radially projectable at a predetermined rotational speed. The flyweight means is projectable to engage against a thrust plate connected to the metering valve to thereby axially shift the metering valve. The transfer pump which is shown is a vane-type pump. The metering valve is biased by a compression spring which is received in a spring seat. The spring seat is positionable to vary the bias of the spring against the metering valve. The valve chamber forms a variable restriction with the distributor passage. The metering valve is axially adjustable by the governor means to vary the quantity of fuel flowing from the valve chamber to the distributor passage.

An object of the invention is to provide a new and improved unit fuel injector and system therefor wherein the pump plunger and the injector valve are mounted independently in the same housing.

An object of the invention is to provide a new and improved unit fuel injector and system therefor wherein the valve lift and the operating pressure of the injection valve may be adjusted independently of the pump plunger.

Another object of the invention is to provide a new and improved unit fuel injector which may be efficiently mounted to an internal combustion engine and which more readily conforms to the headroom constraints of the engine.

A further object of the invention is to provide a new and improved unit fuel injector which is actuable by means of a direct drive from the cam shaft of the engine.

A further object of the invention is to provide a new and improved unit fuel injector and system therefor having improved means for controlling the pump stroke, the quantity of fuel injected into the pump chamber, and the timing of injection of pressurized fuel into the cylinder of the associated engine.

A still further object of the invention is to provide a new and improved unit fuel injector and system therefor having a remote distributor governor means for supplying metered fuel under low pressure to the fuel inlet of the unit fuel injector.

Other objects and advantages of the invention will become apparent from the detailed description and the drawings.

DETAILED DESCRIPTION OF THE DRAWINGS

Figure 1:
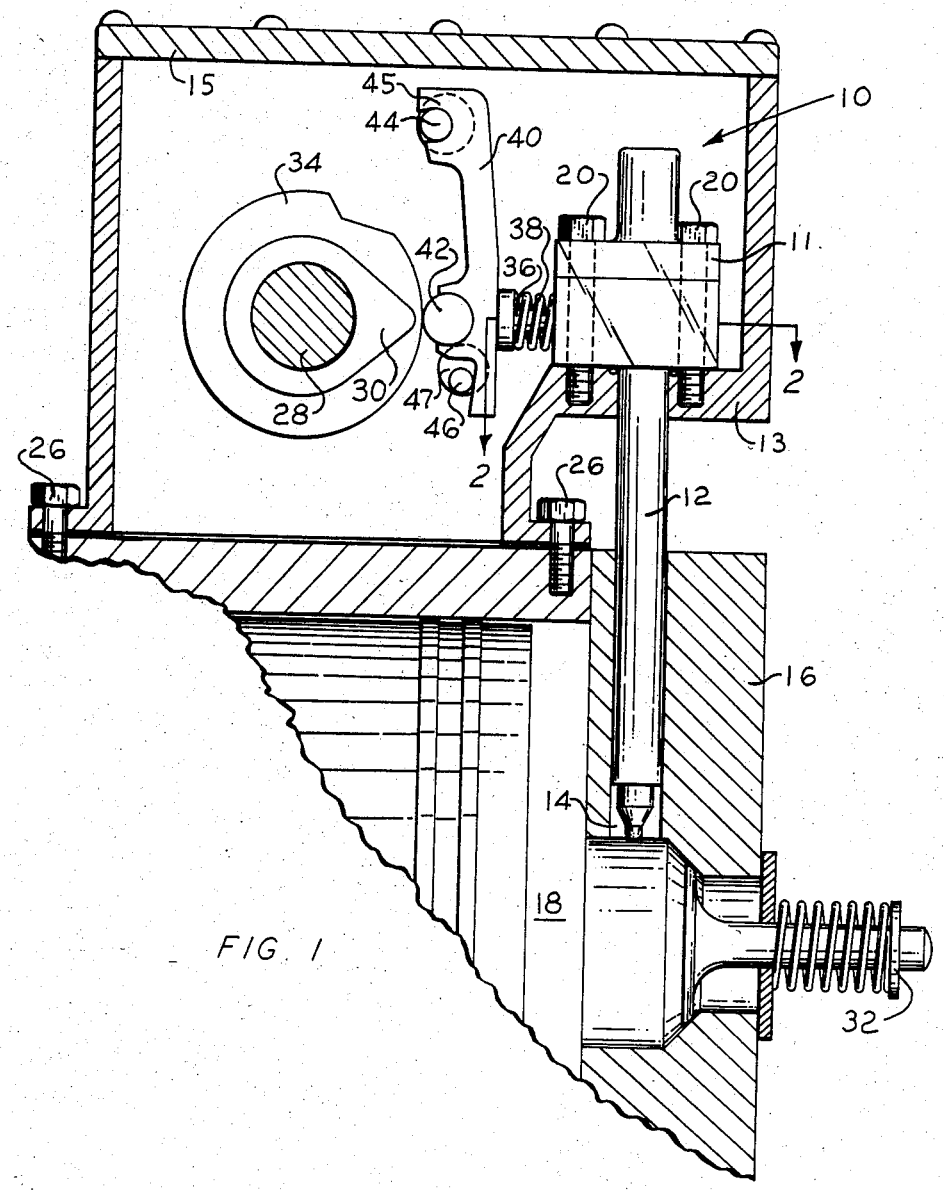
FIG. 1 is a cross-sectional view, partly broken away, of a unit fuel injector of the present invention mounted to a schematically illustrated engine.
Figure 2:
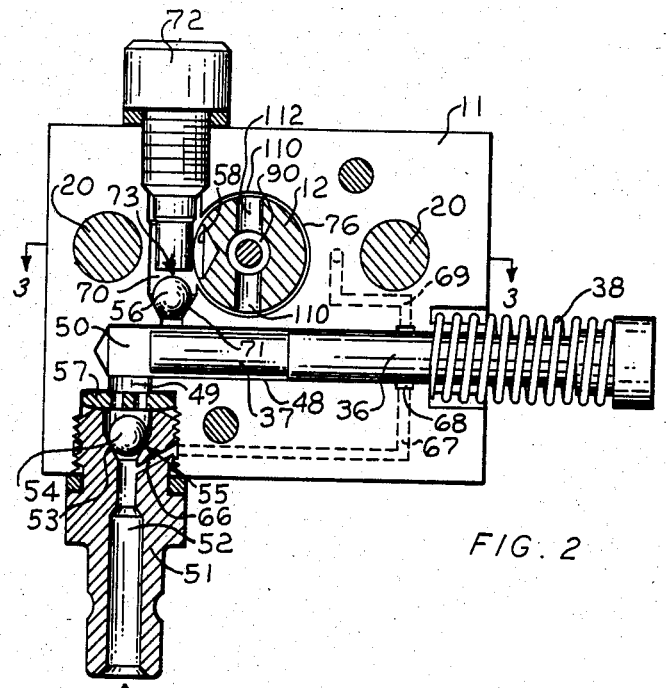
FIG. 2 is an enlarged cross-sectional view, partly broken away, of a portion of the unit fuel injector of FIG. 1 taken along the line 2—2 of FIG. 1.
Figure 3:
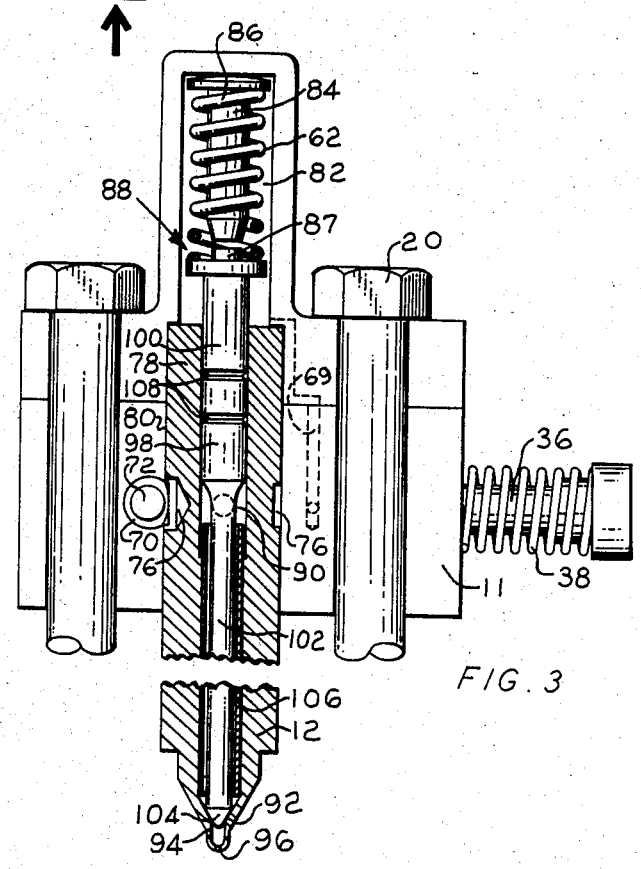
FIG. 3 is a cross-sectional view, partly broken away, of the unit fuel injector of FIG. 2 taken along the line 3—3 of FIG. 2.

Referring now to the drawings in detail wherein the same numerals represent the same or like parts throughout the several drawings, and referring particularly to the embodiment of a unit fuel injector of the present invention illustrated in FIGS. 1–3, a unit fuel injector 10 is illustrated mounted with its tubular injection nozzle body 12 received within a radial bore 14 of a cylinder head 16 of a diesel engine cylinder 18 with which the unit fuel injector is associated. Nozzle body 12 is adapted to be inserted within the cylinder head bore 14 and to sealingly engage the bore.

The tubular nozzle body 12 is mounted to an injector housing 11. Injector housing 11 is mounted within a cam housing 13 by a pair of bolts 20 extending through a cover and body of the injector housing and threaded into the cam housing. The cam housing 13 is secured to the engine cylinder block by bolts 26 which are threaded between a bolt flange and the cylinder block with a suitable sealing gasket being interposed therebetween. The cam housing 13 has a removable access cover 15 to facilitate the installation and maintenance of the unit fuel injector 10.

A cam shaft 28 of the diesel engine has a conventional cam member 30 for actuating an intake valve 32 of the engine cylinder through conventional means not illustrated in the drawings. A second cam member or injector cam 34 is mounted to cam shaft 28 to provide for actuation of the unit fuel injector through an actuating arm 40 and a pushrod 36. The injector cam 34 engages a roller 42 of actuating arm 40 to actuate pushrod 36 inwardly relative to injector housing 11 or to the right, as viewed in FIG. 1. A compression spring 38 is biased to return pushrod 36 and actuating arm 40 outwardly to the left as viewed in FIG. 1. Spring 38 is relatively lightly loaded. Pressure within the injector unit also acts to return pushrod 36. A heavy compression pressure for spring 38 tends to cause cavitation in the injection unit.

The profile of the injector cam 34 is designed to provide proper outward and inward reciprocating actuation of pushrod 36 through intermediate actuating arm 40. Actuating arm 40 is pivotally mounted on an eccentric pin 44 of a timing shaft 45. The position of the actuating arm can be shifted to adjust the timing of the actuating arm 40 and consequently the fuel injection timing of unit fuel injector by angular timing adjustment of the timing shaft. A second eccentric pin 46 is provided on stroke adjustment shaft 47 and is engageable by the halter end of actuating arm 40 to limit the outward movement of pushrod 36 to thereby limit the stroke of a pumping plunger of the unit injector as described below. Angular adjustment of the stroke control shaft thus provides a stroke control unit. The angular adjustments of the timing shaft or the stroke control shaft may be mechanically fixed or may be automatically adjusted throughout the operation of the associated engine by conventional control means which are not illustrated in the drawings. The angular position of shaft 47 is preferably controlled by a governor.

With reference to FIG. 2, injector housing 11 is provided with a transverse bore 48 which is orthogonal to the central axis of nozzle body 12 and transversely offset therefrom. Pushrod 36 is closely received in transverse bore 48 and forms at an inner portion thereof a pump plunger 37 which reciprocates in a pumping chamber 50 formed in the inner portion of transverse bore 48. In the unit fuel injector of FIG. 1–3, pushrod 36 and plunger 37 are integrated to form a single component. A counterbore at the outer end of transverse bore 48 is employed to receive the inner end of plunger return spring 38. The return spring 38 is mounted in an annular groove at an inner end of the spring and a circumferential shoulder at the outer end to prevent spring 38 contacting the sealing surface of the pushrod/plunger.

A threaded stepped bore 49 opens into pumping chamber 50 and is disposed at a right angle to the longitudinal axis of transverse bore 48 to receive a threaded fuel inlet connector 51 enclosing an inlet ball check valve 55. Connector 51 provides a structure for receiving fuel under low pressure supplied in the general direction of the arrow of FIG. 2 Fuel inlet connector 51 is provided with a fuel inlet passage 52 which flares to an enlarged innerconical bore which receives a ball 54 for restricted movement therein. The flare region forms a conical seat 53. Ball 54 is seated in the conical seat 53 to form a seal which prevents an outward flow of fuel during the inward displacement of pump plunger 37 in chamber 50 because the pumping pressure exerted against ball 54 is greater than the relatively low inlet fuel pressure. During outward displacement of pump plunger 37 (to the right of FIG. 2) fuel flowing through inlet passage 52 (in the direction of the arrow of FIG. 2) is free to pass inwardly to pump chamber 50, ball 54 being upwardly unseated. The upward position of ball 54 is limited by a perforated limit plate 57 which is secured in the inlet bore by the threaded inlet connector 51.

A return passage 66 is provided in inlet connector 51 upstream of the ball check valve 55 for communication with a return passage 67 in injector housing 11 which passage 67 opens into a pressure return annulus 68 surrounding plunger 37. Passages 66 and 67 and return annulus 68 provide a path to the fuel inlet passage 52 for a return of fuel which leaks past plunger 37. Return annulus also communicates with a return passage 69 which returns fuel from the nozzle body 12. Alternately, passage 66 may be employed to provide means for removing air at the fuel inlet. Passage 67 may alternately lead to the fuel reservoir rather than the fuel inlet as illustrated.

A second partly threaded stepped bore 70 is provided in the injector housing 11 to receive an outlet plug assembly. Bore 70 is generally parallel to bore 49, bores 70 and 49 communicating at opposite sides of transverse bore 48. Bore 70 forms a passage having a conical seat 71 which cooperates with a ball 56 to form a one-way outlet ball valve 73. Ball 56 is further secured in bore 70 by a threaded plug 72 threaded into housing 11 and sealingly secured by a gasket 74. Bore 70 forms an internal passage which communicates via passage 58 with an annular circumferential groove 76 which is defined by the body of a nozzle valve as will be further described hereinafter.

With reference to FIG. 3, nozzle body 12 is securely mounted within aligned bores 78 and 80 of the injector housing cover and housing body, respectively. An integral projection of the housing cover provides a cylindrical chamber 82 coaxial with the nozzle body. An inner end stop 84 and compression spring 86 are mounted within chamber 82 for engagement through spring seat 87 with a needle valve generally designated by numeral 88. Stop 84 and spring 86 function to limit the inward displacement or lift of the needle valve and to seat the valve. The needle valve may be similar to that described in U.S. Pat. No. 4,163,521 entitled "Fuel Injector" and assigned to the assignee of the present invention. An outward displacement or poppet type nozzle (not illustrated in the drawings) may be employed instead of an inward displacement valve as illustrated.

Nozzle body 12 has a central bore 90 which forms a valve chamber. A tapered or conical valve seat 92 is located at one end of the valve chamber and formed on an integral discharge tip 94 including at least discharge orifice 96. A rod-like plunger valve 98 includes a rear cylindrical guide portion 100 slidably mounted in central bore 90 and a front stem portion 102 having a conical tip 104 which cooperates with valve seat 92 to control the discharge of fuel from the valve chamber through discharge orifice 96. A cylindrical sleeve 106 is preferably provided in bore 90 to reduce the volume of the valve chamber to minimize the cushioning effect resulting from the slight compressability of the fuel supplied to the nozzle under high pressure and to achieve uniformity in successive fuel charges delivered to the engine as more fully described and claimed in U.S. Pat. No. 3,876,152 entitled "Non-Coking Fuel Injector Nozzle" and assigned to the assignee of the present invention. A pair of longitudinally spaced peripheral grooves 108 may also be provided on guide portion 100 to allow the valve to freely chatter, i.e., to reciprocate rapidly and frequently between an open and closed position during injection as described in U.S. Pat. No. 3,722,801 entitled "Fuel Injector" and assigned to the same assignee as the present invention.

With reference to FIG. 2 and FIG. 3, nozzle body 12 is provided with a plurality of inlet ports 110 (two being illustrated) which are angularly spaced and radially located to open into a passage 112 which extends inwardly from groove 76 to central bore 90 to supply pressurized fuel to the valve chamber. The restricted passageway provided by annular groove 76 may serve as a filter for the fuel flowing into the valve chamber as described in U.S. Pat. No. 4,163,521 entitled "Fuel Injector" and assigned to the assignee of the present invention. Return passage 69 communicates between chamber 82 and return annulus 68 to provide a fuel return path for fuel which leaks into chamber 82.

The cam housing 13 may be filled with fuel under a suitable pressure to lubricate the moving parts of the unit injector. In a preferred form of the invention, fuel is supplied to the unit fuel injector under a relatively low pressure via a conduit (not shown) which is secured to the outer end of the inlet connector 51.

During engine operation, the pump plunger 37 is reciprocated by means of injector cam 34, roller 42, actuating arm 40, pushrod 36, and return spring 38 to deliver fuel charges under high pressure to the injection nozzle for fuel injection through discharge orifice 96 into the combustion space of engine cylinder 18. During the intake stroke of pump plunger 37 under the bias force of return spring 38 (the intake stroke resulting in a movement of pushrod 36 to the left in FIG. 1 and to the right in FIG. 2) fuel enters the pump chamber 50 from fuel inlet passage 52 via inlet check valve 55 while the outlet check valve 73 is closed to maintain fuel pressure upstream of the outlet check valve in the pump chamber 50. As the plunger 37 is actuated inwardly, ball 54 is seated to close inlet check valve 55, and ball 56 is forced out of its valve seat to open outlet check valve 73 because of the rise in the fuel pressure in pump chamber 50. The pressurized fuel is forced via passage 58 into annular groove 76 which surrounds needle valve 88 and in particular valve member 98. When the pressure within the annular groove 76 surrounding the needle valve 88 reaches a predetermined level, determined by the bias of the injector valve spring 86, needle valve 88 is lifted (upwardly relative to the illustrated position of FIG. 3) to provide for fuel injection through discharge orifice 96 into the engine cylinder. A small clearance gap between spring seat 87 and stop 84 fixes the displacement or lift of needle valve 88.

After injection of fuel into the engine cylinder, the outlet check valve 73 is closed to maintain upstream pressure until a succeeding pump stroke of a fuel injection cycle as described above. The outlet check valve 73 therefore functions as a delivery valve to maintain upstream fuel pressure between injection cycles. Outlet check valve 73 is considered to be an optional feature in view of the relatively small void volume downstream of the check valve.

A unit fuel injector 10 as described above provides a unit injector which can be efficiently mounted for operation in association with an internal combustion engine because the configuration efficiently exploits headroom constraints, and the injector can be directly driven from the overhead cam shaft of the engine. Moreover, a single injector housing 11 can be employed both for the injector nozzle portion and the injection pump portion so that there are no joints susceptible to leakage from the high pressures. There is no contact between the pump plunger and the nozzle valve plunger so that the mechanical pumping force of the unit injector imposes no side thrust on the nozzle valve plunger. The operation of unit fuel injector 10 involves very small passage volume subjected to high pressure fuel.

Figure 5:
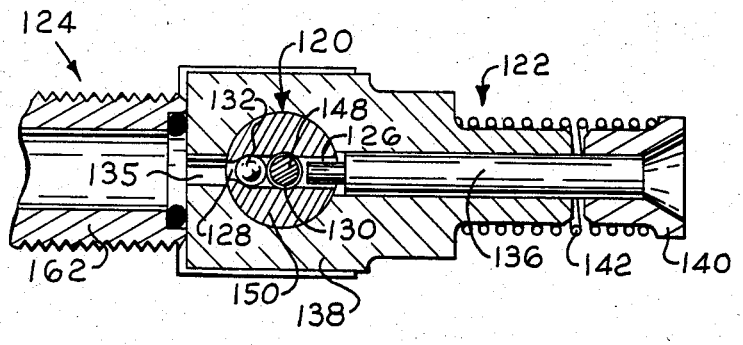
FIG. 5 is a cross-sectional view, partly broken away, of the unit fuel injector of FIG. 4 taken along the line 5—5 of FIG. 4.
Figure 4:
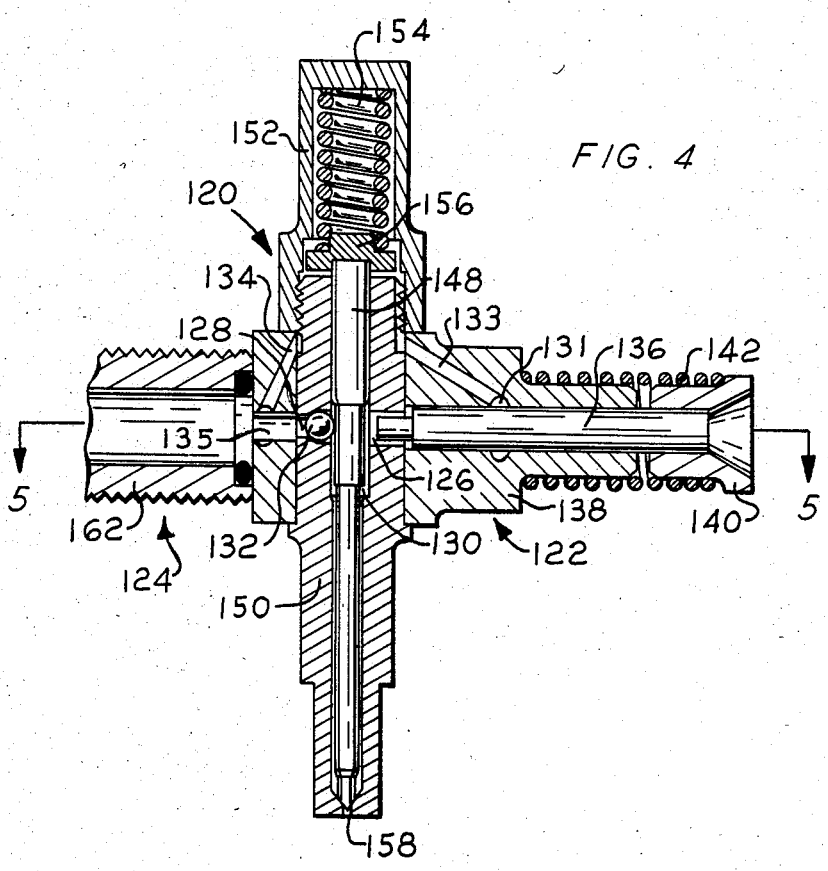
FIG. 4 is a cross-sectional view, partly broken away, of a portion of an alternate embodiment of a unit fuel injector.

With reference to FIGS. 4 and 5, an alternate embodiment of a unit fuel injector is illustrated. The alternate embodiment does not employ an outlet check valve as previously described with reference to the unit fuel injector of FIG. 1 through FIG. 3. The unit injector of FIG. 4 and FIG. 5 is generally similar in description to that previously described and functions in a similar manner, except for the modifications noted below. With reference to FIG. 4, pump plunger assembly 122, and inlet connector assembly 124 are disposed at right angles relative to nozzle valve assembly 120 and in a substantially coplanar relationship so that pump chamber 126 and inlet passage 128 open into nozzle valve chamber 130 from opposite directions at a central location in the unit injector.

Pump plunger assembly 122 comprises a plunger 136 mounted in aligned bores of a mounting member 138 and a cap 140. A return spring 142 is mounted between opposing exterior sleeve portions of the mounting member 138 and cap 140. A return annulus 131 and return passage 133 provide a path for a return of the fuel which leaks past the sealing surface of the plunger. Plunger 136 is actuated (by means not illustrated in FIG. 4 and FIG. 5) to reciprocate in a manner analogous to that of plunger 37. Mounting member 138 receives nozzle body 150 and mounts inlet connector assembly 124. An inlet bore 135 aligns with the plunger bore. Return passage 134 empties into inlet bore 135.

Nozzle valve assembly 120 comprises a needle valve 148 slidably received in a central longitudinal bore of nozzle body 150. Nozzle body 150 is threaded to a nozzle cover 152. Cover 152 forms a chamber to receive a compression spring 154 which is connected to needle valve 148 by a spring seat 156. The needle valve functions to discharge pressurized fuel through discharge orifice 158 in a manner analogous to the nozzle valve assembly described with respect to FIG. 1 through FIG. 3. A return annulus connects with passage 133 and 134 to return fuel which leaks past the needle valve and pump plunger to the inlet bore 135. Nozzle body 150 also includes an aligned bore which opens into chamber 130 to form inlet passage 128 and pump chamber 126. Inlet passage 128 aligns with inlet bore 135. A one-way ball valve 132 is interposed in passage 128.

Inlet connector assembly includes an inlet conduit 162 which aligns with inlet bore 135 and seals against mounting member 138. Low pressure fuel flows through the inlet conduit 162, inlet bore 135, and inlet passage 128 past inlet check valve 132 into nozzle valve chamber 130. Chamber 130 also opens into pump chamber 126 when the pump plunger 136 is in the intake stroke (movement to the right in FIGS. 4 and 5). On the pumping stroke of plunger 136 (movement to the left in FIG. 4 and FIG. 5) the fuel is pressurized and ultimately forces valve 132 to close and needle valve 148 to lift at a predetermined fuel pressure to open the nozzle valve and discharge pressurized fuel through orifice 158 into the engine cylinder. During the pumping stroke of plunger 136, intake check valve 132 is closed by the pumping pressure seating a ball against a conical seat in the inlet passage 128 to prevent a reverse flow of pressurized fuel and a release of pressure through the inlet passage.

Figure 7:
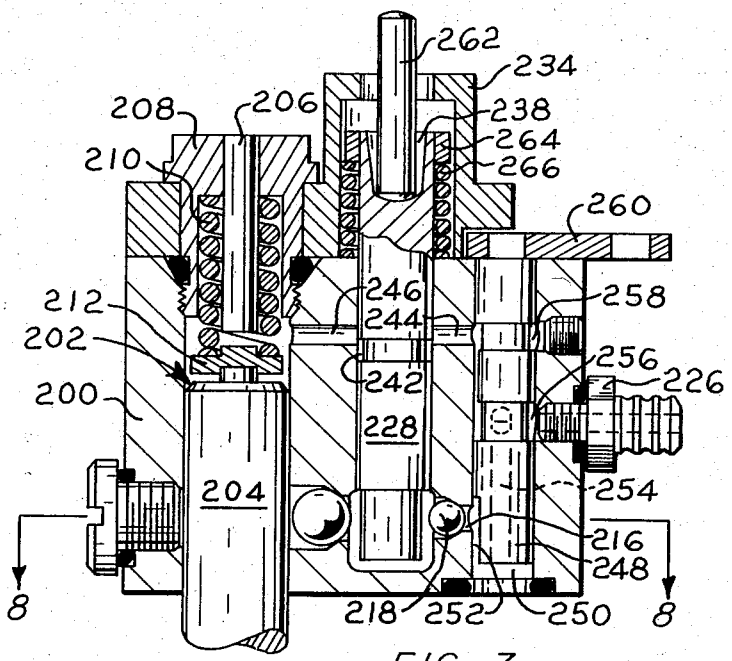
FIG. 7 is a cross-sectional view, partly broken away, illustrating a third alternate embodiment of a unit fuel injector.
Figure 6:
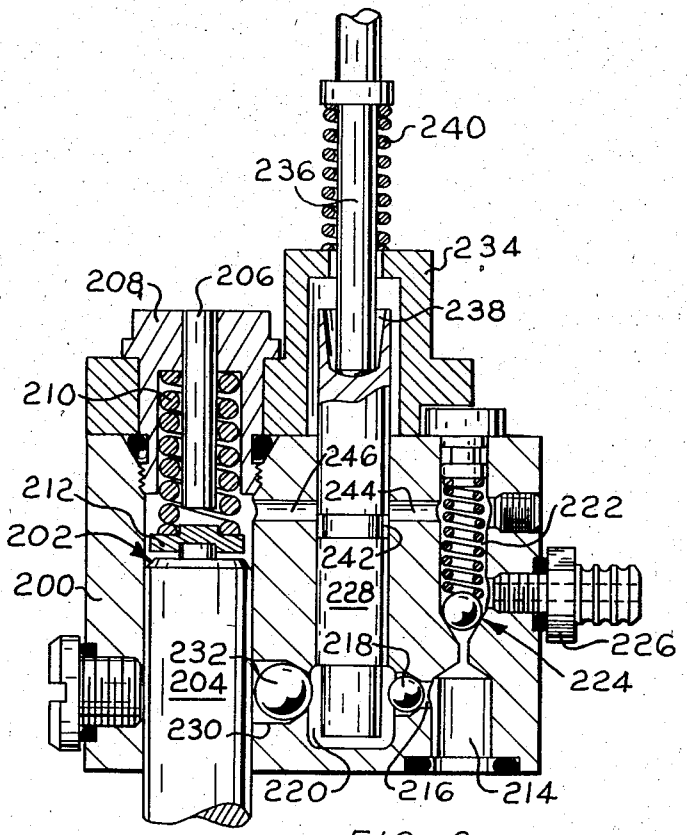
FIG. 6 is a cross-sectional view, partly broken away, illustrating a second alternate embodiment of a unit fuel injector.
Figure 10:
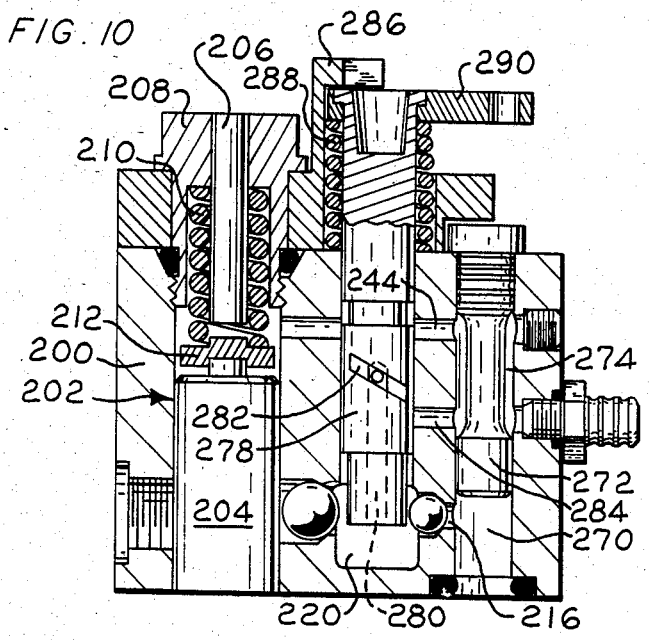
FIG. 10 is a cross-sectional view, partly broken away, illustrating a fourth alternate embodiment of a unit fuel injector.

With reference to FIGS. 6, 7, and 10, three additional embodiments of a unit fuel injector in accordance with the present invention are illustrated. The latter embodiments may generally be described as having a parallel configuration as contrasted to the transverse configurations of the unit injector illustrated in FIG. 1 through FIG. 3 and the unit injector illustrated in FIG. 4 and FIG. 5. The unit injectors of FIGS. 6, 7 and 10 each comprise a housing body 200 having three parallel interconnected bores for receiving a nozzle valve assembly, a plunger assembly, and an inlet/fuel return assembly.

A nozzle valve assembly 202 is generally identical for all three of the parallel unit injector configurations and generally includes a needle valve 204 (only a portion of which is illustrated) which is substantially identical in form and operation to needle valves 88 and 148. A lift stop 206 is centrally located within a cap member 208 which is threaded into housing body 200 and sealingly secured by a gasket. A compression spring 210 is circumferentially mounted around stop 206 within cap member 208 to extend between the top interior of cap member 208 and spring seat 212 which seat connects to the top of the nozzle valve. A gap between the lift stop 206 and the spring seat 212 determines the upper limit of the needle valve when the valve is raised by the pressurized fuel for fuel injection through a discharge orifice (not shown).

With specific reference to the unit fuel injector of FIG. 6, a fuel inlet 214 opens transversely into an inlet passage 216 containing a one-way ball check valve 218 which controls the flow of fuel into pumping chamber 220. Fuel inlet 214 also opens via narrow passage into a fuel release chamber 222 which passage is normally closed by a spring biased ball pressure valve 224. A transfer plug 226 is sealingly threaded into housing body 200. Transfer plug 226 has an interior passage which communicates with fuel release chamber 222 and opens outwardly so that a fuel return conduit (not illustrated) coupled to the outer portion of plug 226 will provide a means for returning fuel to the fuel reservoir of the associated internal combustion engine.

A floating plunger 228 which does not form an integral structure with a pushrod reciprocates in pumping chamber 220 to pressurize fuel for delivery via transverse passage 230 to the nozzle valve assembly 202 for injection into the engine cylinder. A one-way ball check valve 232 is positioned in passage 230 so that residual pressure in passage 230 prevents back flow to pumping chamber 220 during the intake stroke of floating plunger 228. By contrast, check valve 218 is in the open position during the intake stroke of plunger 228 and closed during the pumping stroke of plunger 228.

Housing body 200 is provided with a cover having an integral cap 234 which defines a stepped bore for enclosing floating plunger 228 and slidably receiving actuating rod 236. Actuating rod 236 is aligned so that one end is engageable against the bottom of a contact recess 238 disposed at the (outer) upper end of floating plunger 228. A compression spring 240 biases actuating rod 236 outwardly to bear against an actuating arm (not illustrated) in a manner such as described relative to FIG. 1. Spring 240 may have a greater loading force than spring 38 because of the floating characteristics of plunger 228. Floating plunger 228 further includes an annular release passage 242 which connects between passages 244 and 246 to define a fuel return path so that the leakage fuel may be returned to fuel release chamber 222.

The unit fuel injector of FIG. 6 is especially adapted to be employed in association with a cylinder of a multi-cylinder engine wherein the fuel transferred to fuel inlet 214 is metered by a separate governor distributor unit such as disclosed in FIG. 9 and as will be more fully described hereinafter. The size of the fuel charge introduced into pump chamber 220 is a function of the amount of fuel supplied by the inlet metering means, the plunger floating to a position dictated by the quantity of fuel in chamber 220. A timing control to provide a fine adjustment to the timing of a pump stroke, such as disclosed relative to the unit injector shown in FIG. 1, may be employed. A stroke control may not be required because of the inlet metering of the fuel. However, a stroke control means providing a maximum limit may be advantageously employed with the unit fuel injector of FIG. 6.

Figure 8:
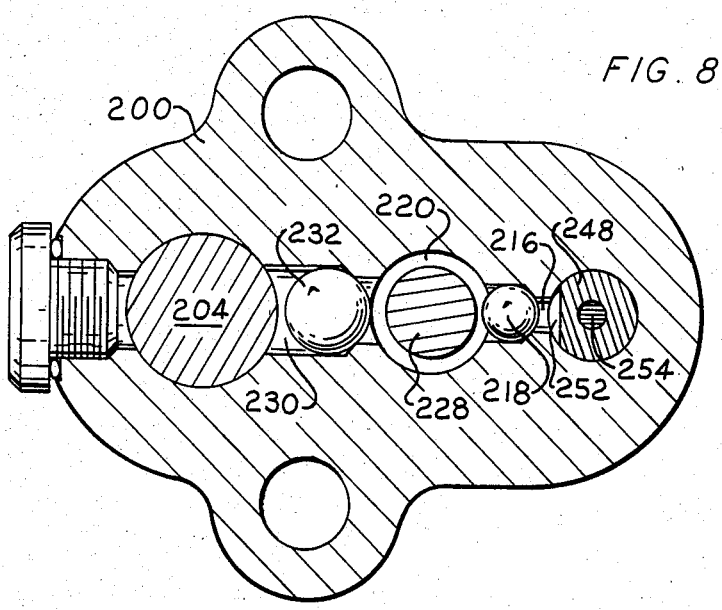
FIG. 8 is an enlarged cross-sectional view of the unit fuel injector of FIG. 7 taken along the line 8—8 of FIG. 7.

The unit fuel injector of FIG. 7 and FIG. 8 differs from the unit fuel injector of FIG. 6 primarily in the fuel metering means and secondarily in the plunger assembly. The unit fuel injector of FIG. 7 may be advantageously employed in association with a single cylinder internal combustion engine. An elongated inlet metering valve 248 is disposed in an inlet bore 250 which extends through opposite sides of housing body 200. Inlet metering valve 248 includes an axially disposed surface parallel to the longitudinal axis of the valve 248 which surface defines a metering inlet 252 opening into transverse inlet passage 216. Inlet passage 216 has a one-way ball check valve 218 as previously described. Inlet metering valve 248 includes an axial bore 254 extending from the fuel inlet and opening radially into a return chamber 256 formed between inlet bore 250 and an intermediate portion of inlet metering valve 248. Return chamber 256 communicates with transfer plug 226. A return annulus 258 is also provided between inlet bore 250 and inlet metering valve 248. Return annulus 258 communicates with return chamber 256 by way of an intermediate passage defined by valve 248 and inlet bore 250. Axial bore 254 and return chamber 256 function to provide a means for returning excess fuel at the fuel inlet to the tank or fuel reservoir of the engine and for venting air. Inlet metering valve 248 is connected to a metering arm 260 which is located exterior to housing body 200 and is positionable to angularly position inlet metering valve 248. With reference to FIG. 8, inlet metering valve 248 may be angularly adjusted by metering arm 260 to form a variably restricted passageway to transverse passage 216 to thus control the quantity of fuel flowing to pumping chamber 220.

The stroke of plunger 228 is controlled primarily by the quantity of fuel supplied to the pumping chamber 220, although a stroke control stop which limits the maximum stroke position of actuating rod 262 may also be employed in the unit fuel injector of FIG. 7. Plunger 228 is further provided with a spring seat 264 and a circumferentially mounted compression spring 266 positioned interiorly of housing cap 234. Spring 266 acts to bias actuating rod 262 outwardly upon receptive contact between actuating rod 262 and contact recess 238.

A spill control embodiment of a unit fuel injector having a parallel configuration is illustrated in FIG. 10. With reference to FIG. 10, an inlet bore 270 is threaded or press fitted with an inlet plug 272 having an intermediate recessed portion defining with bore 270 a return chamber 274. Chamber 274 communicates with return passage 244 and a transfer plug to return fuel to the fuel reservoir as previously described and also to return spill fuel. Fuel enters an inlet passage defined in bore 270 by the inner end of plug 272 for communication with transverse inlet passage 216 into pump chamber 220.

The metering means for metering the quantity of fuel ultimately delivered to the engine cylinder is accomplished in the injection pumping mechanism. Pump plunger 278 includes an axial passage 280. A spill slot 282 is disposed in the outer diameter of the plunger 278 and is oriented obliquely relative to axial passage 280 and radially communicates with axial passage 280. Spill slot 282 is selectively alignable with return passage 284 which communicates with return chamber 274. Plunger 278 is secured in housing body 200 by a check plate 286 which provides a limit for the stroke of plunger 278. A compression spring 288 acts to bias plunger 278 outwardly relative to the housing. Plunger 278 further connects with a spill metering arm 290, the annular position of which determines the angular orientation of spill slot 282 and consequently the alignment level of spill slot 282 with return passage 284. After fuel is introduced into pumping chamber 220, and the plunger 278 starts its downward injection stroke, the fuel is forced through axial passage 280 into spill passage 282. The alignment level of spill passage 282 with return passage 284 determines the quantity of fuel which will be injected before spill fuel is returned to a fuel reservoir through return passage 284. Thus, the angular position of plunger 278 determined by spill metering arm 290 provides a metering means to control the quantity of injected fuel for each given injection stroke of plunger 278. The unit fuel injector of FIG. 10 may be employed in connection with a timing control means operating through an actuator arm (not shown), but any additional stroke control means is not required.

Figure 9:
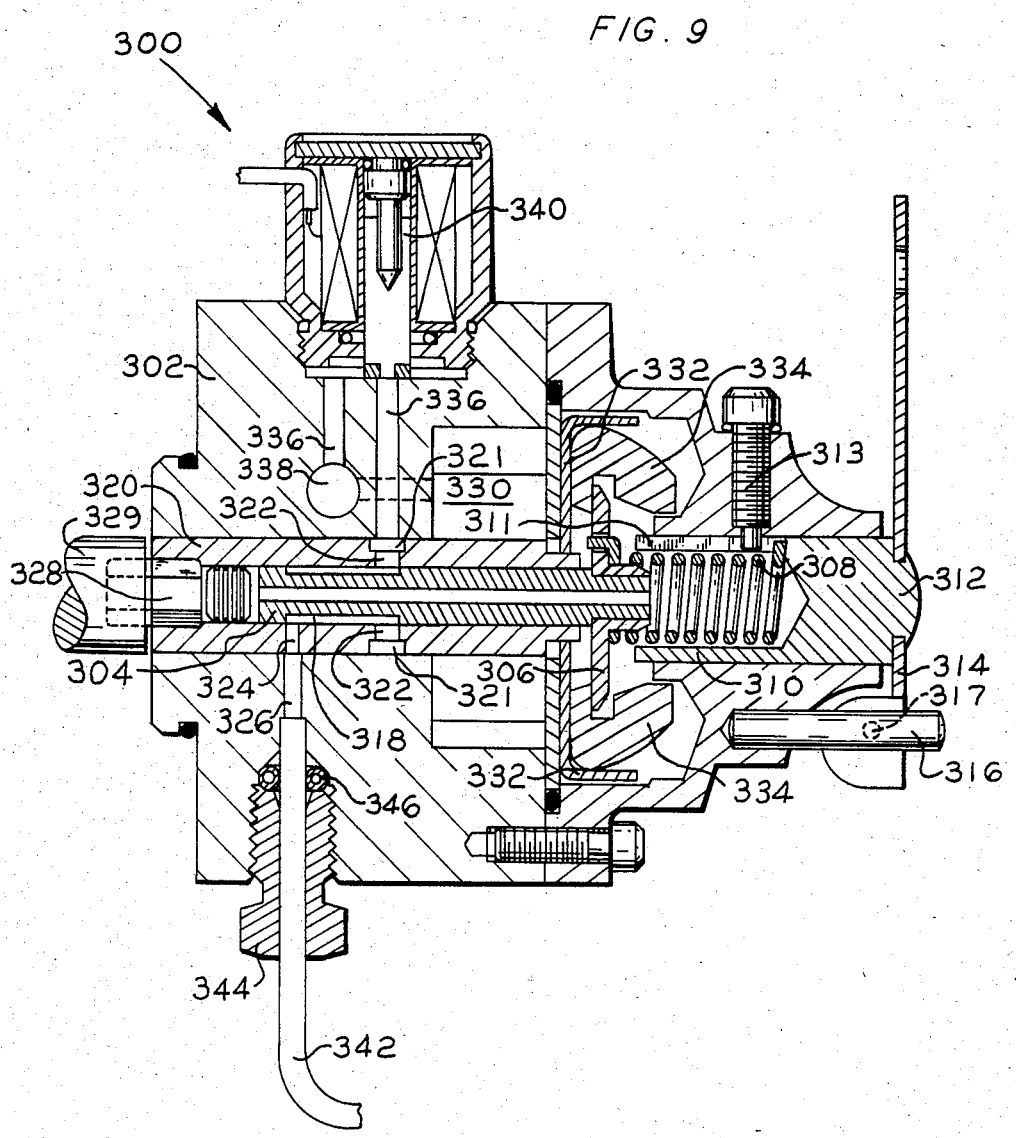
FIG. 9 is a cross-sectional view of a governor/distributor unit employed in connection with a unit fuel injector.

A means for metering the quantity of fuel delivered to the fuel inlet of a unit fuel injector may alternately be accomplished by means remote from the unit fuel injector such as governor distributor unit 300 as illustrated in FIG. 9. In general, governor distributor unit 300 is most advantageously employed in multi-cylinder combustion engines having a unit fuel injector at each of the cylinders. Low pressure fuel is metered and delivered by the governor distributor unit to the fuel inlets of unit fuel injectors of a form such as illustrated in FIG. 3,4, or 6 for ultimately sequentially injecting of pressurized fuel into the cylinders of the engine.

With reference to FIG. 9, governor distributor 300 includes a housing 302 having a central longitudinal bore which receives a rotatable sleeve-like distributor rotor 320 and a generally nonrotatable distributor shaft 304 interior of distributor rotor 320 and in axially slidable engagement therewith. Distributor shaft 304 connects at one end to a radial thrust plate 306 which is rearwardly biased by a compression spring 308. Spring 308 is circumferentially mounted at a rear portion around the end of shaft 304 and a concentric sleeve-like seat of thrust plate 306. The rear end of spring 308 is keyed to plate 306. Compression spring 308 is mounted at a front portion within a sleeve 310 having a helical slot 311 and which forwardly terminates in an adjustable spring seat 312. The front end of spring 308 is keyed to slot 311. A screw 313 threaded into the housing includes an inwardly projecting follower which is received in helical slot 311 so that angular rotation of sleeve 310 results in axial displacement of spring seat 312.

A position arm 314 connects at an intermediate position to spring seat 312. Position arm 314 connects at an outer end via linkage (not shown) to the engine throttle. The angular position of arm 314 functions to determine the axial position of spring seat 312 via the angular positioning of sleeve 310 and slot 311, and thus the axial bias force of spring 308 against distributor shaft 304. The degree of compression of spring 308 is varied in accordance with the axial position of spring seat 312.

A pin 316 projects rearwardly and generally parallel to the central longitudinal bore of the housing. A set screw 317 (shown in dashed lines) is threaded in pin 316. Set screw 317 is threadedably adjustable to provide a stop which bears against a plate fixed to an end of position arm 314. By limiting the angular rotation of arm 314, set screw 317 essentially provides an idle stop as will become apparent from the description hereinafter.

A key 328 connects distributor rotor 320 to drive shaft 329 from the engine crankshaft (partially shown) for rotatably driving the distributor rotor. Distributor rotor 320 drives a vane-type low pressure transfer pump 330 which functions to supply fuel under a relatively low pressure to the fuel inlet of a unit fuel injector. Distributor rotor 320 also connects to a radially disposed flyweight cage 332. Flyweights 334 are captured by cage 332 and are pivotal at an outer heel portion to form a pivot axis transverse of rotor 320. Flyweights 334 are suitably contoured to form a recess for receiving an outer peripheral portion of thrust plate 306, a thrust surface at the toes of said flyweights bearing against the inner surface of the thrust plate. Distributor rotor 320 is also provided with an annulus 321, an inlet passage 322, and a distributor passage 324 axially separated from inlet passage 322. Inlet passage 322 is preferrably a diametral bore which is in continuous communication with annulus 321, and inwardly communicates with a peripheral axially extending annulus 318 of shaft 304. Distributor passage 324 is alignable for communication with annulus 318 and for sequential registration with one or more angularly spaced transfer passages 326 (only one illustrated in FIG. 9). There is generally one transfer passage for each cylinder of the associated engine.

A connector fitting 344 may be employed to connect transfer conduit 342 with transfer passage 326 by threadably tightening fitting 344 against a compression seal 346 in a bore of housing 302. Transfer conduit 342 provides a conduit for transferring the low pressure metered fuel to the fuel inlet of the unit fuel injector.

Transfer pump passage 336 leads from the transfer pump 330 to annulus 321. A pressure regulator valve 338 (schematically illustrated) and an electrical shut-off means 340 are interposed in passage 336. Electrical shut-off means 340 is considered to be an optional feature which provides a convenient means for shutting off the fuel supply to the engine cylinders to terminate operation. The electrical shut off means 340 is energized to be opened, i.e., to allow fuel to flow to the inlet passage 322.

In operation, fuel flow from a fuel reservoir (not shown) to the transfer pump 330 which together with distributor rotor 320 is rotated by drive shaft 329. The transfer pump in combination with regulator 338 produces a speed related transfer pressure which is sufficient for transferring metered fuel from the governor distributor 300 to the fuel inlet of a unit fuel injector. Fuel flows through transfer pump passage 336 and is continuously supplied to an annulus 321 which opens into inlet passage 322. The fuel then flows from inlet passage 322 to annulus 318 in shaft 304 to distributor passage 324 and through transfer passage 326 to transfer conduit 342. It should be noted that there are preferably a plurality of angularly spaced transfer passages 326. Passage 324 sequentially indexes with the transfer passages during rotation of distributor sleeve 320. Metered fuel is thus sequentially distributed to the passages for delivery to the corresponding unit fuel injectors.

During the operation of the governor distributor unit, shaft 304 is essentially non-rotating while distributor rotor 320 is rotating. When the speed of the distributor rotor 320 reaches a predetermined value depending on the force applied by spring 380, flyweights 334 pivot outwardly (radially outwardly relative to the central distributor sleeve as shown in FIG. 9) so that the flyweight thrust surfaces act against radial thrust plate 306 to force the thrust plate and hence the shaft 304 axially forwardly (to the right as shown in FIG. 9).

Annulus 318 of shaft 304 is alignable with inlet passage 322 and distributor passage 324 of distributor sleeve 320 to form a variable area flow passage between annulus 318 and passage 324 so that the axial position of shaft 304 determines the quantity of fuel flowing from transfer pump passage 336 to transfer passage 326 and ultimately to transfer conduit 342. Thus the axial shifting of shaft 304 relative to distributor rotor 320 acts as a metering valve to determine the quantity of fuel delivered to the fuel inlet of the unit fuel injector. The axial shifting of the shaft 304 functions as a governing means on the quantity of fuel flowing to the unit fuel injector by forming a variable restriction between annulus 318 and distributor passage 324. Annulus 318 is in continuous communication with passage 322. As annulus 318 is shifted to the right at higher speeds from the essentially normal speed non-governing position of FIG. 9, the end of annulus 318 forms a variable restriction with passage 324. Generally, the higher the engine speed, the narrower the restriction and consequently the smaller the quantity of fuel which is conducted to the unit fuel injector. Of course, the axial position of annulus 318 is also controlled by the variable bias force exerted by spring 308 against thrust plate 306. Preferably the bias force exerted by spring 308 is responsive to the engine throttle position communicated via mechanical linkage to position arm 314. An idle stop is provided by set screw 317 which mechanically defines an axial position limit for spring seat 312.

Various embodiments of the present invention have been set forth purposes of illustrating and should not be deemed a limitation of the present invention. Accordingly, various modifications, adaptations, and alternatives may occur to one skilled in the art.

What is claimed is:

1. A unit fuel injector for an internal combustion engine having a cylinder, an associated cylinder head and a cam shaft driven by said engine, said injector unit comprising:

an injection nozzle received in a bore in said cylinder head, said nozzle including an injection valve and a discharge tip at one end thereof to inject pressurized fuel into said cylinder;

an injector housing having a pair of generally parallel, laterally offset, overlapping, contiguous bores, the housing being adapted to be mounted to said engine and the housing receiving said injection nozzle in one of said bores;

fuel injection pump means mounted in said housing and including a pump plunger actuable by the cam shaft, said plunger being reciprocable in a pump chamber formed by a second of said bores, the housing having a fuel transfer passage extending transversely of said second bore and connecting the pump chamber to said one bore to supply pressurized fuel to the injection nozzle;

fuel inlet means in said housing including a fuel inlet passage in said housing in communication with said pump chamber to supply fuel under low pressure to said pump chamber; and metering means for controlling the quantity of fuel supplied to said pump chamber.

2. The unit fuel injector of claim 1 wherein said plunger reciprocates in said pump chamber at least partially by means of a spring biased pushrod actuable exteriorly of the injector housing.

3. The unit fuel injector of claim 2 wherein the pushrod bears against an actuating arm, a cam member being mounted on the cam shaft, the contour of the cam member being translatable into pivotal movement of said actuating arm.

4. The unit fuel injector of claim 3 further comprising stroke control means for limiting the stroke of said plunger in said pump chamber.

5. The unit fuel injector of claim 4 wherein said stroke control means comprises an eccentric pin pivotally mounting said actuating arm, said pin being angularly adjustable to limit the movement of said plunger.

6. The unit fuel injector of claim 3 further comprising timing means to control the timing of the actuating of said pushrod by said actuating arm.

7. The unit fuel injector of claim 6 wherein the timing means comprises an eccentric pin angularly adjustable to control the position of said actuating arm.

8. The unit fuel injector of claim 1 wherein the metering means comprises means limiting the movement of said pump plunger.

9. The unit fuel injector of claim 1 wherein the metering means comprises a metering valve in the fuel inlet means, said metering valve having a variable restriction which is angularly positionable to control the quantity of fuel passing therethrough.

10. The unit fuel injector of claim 1 wherein the metering means comprises an axial passage in said plunger and a spill passage disposed obliquely relative to said axial passage, said axial and spill passages communicating with the pumping chamber and a return passage, the plunger being angularly positionable to control the quantity of fuel in said pump chamber.

11. The unit fuel injector of claim 1 wherein the injection valve comprises a pressure operated member normally biased against a valve seat, said member being slidable when pressurized fuel is supplied to the injection nozzle to inject pressurized fuel through said discharge tip.

12. The unit fuel injector of claim 1 wherein said pump plunger reciprocates relative to a longitudinal axis, said injection nozzle being disposed generally transverse and offset from said longitudinal axis.

13. The unit fuel injector of claim 12 wherein said fuel inlet passage opens into said pump chamber perpendicularly to said longitudinal axis.

14. The unit fuel injector of claim 13 wherein said fuel inlet means further includes a one-way check valve.

15. The unit fuel injector of claim 14 wherein said check valve comprises a ball sealable against a conical seat.

16. The unit fuel injector of claim 14 wherein the injection nozzle further includes a valve chamber, said pump chamber and check valve being adjacent said valve chamber.

17. The unit fuel injector of claim 1 further comprising a fuel return means to return fuel to said fuel inlet means.

18. The unit fuel injector of claim 1 further comprising an outlet passage connecting said pump chamber and said injection nozzle, an outlet check valve being interposed in said outlet passage.

19. The unit fuel injector of claim 1 wherein said pump plunger is a floating plunger and said fuel injection pump means includes a pushrod slidably engageable with said floating plunger.

20. The unit fuel injector of claim 1 wherein said injection valve and pump plunger reciprocate movable along substantially parallel axes.

21. The unit fuel injector of claim 1 further comprising a reservoir return means for returning excess fuel to the fuel reservoir of the engine.

22. The unit fuel injector of claim 1 wherein the fuel inlet means further includes a pressure release means.

23. A unit fuel injector for an internal combustion engine comprising:

an injector housing including a body portion having three generally parallel, laterally offset, overlapping, contiguous bores therein, said housing being adapted to be mounted to an associated engine;

an injection nozzle received in one said bore, said nozzle including a valve chamber, an injection valve, and a discharge tip at one end thereof to inject pressurized fuel;

fuel injection pump means to pressurize fuel received in a second said bore, said pump means including a pump plunger reciprocal in a pump chamber formed by said second bore, the body portion having a first transverse passage extending transversely of said second bore and connecting said pump chamber with said valve chamber to supply pressurized fuel to said valve chamber; and the body portion having a second transverse passage extending transversely of said second bore and connecting a third said bore with said pump chamber to supply low pressure fuel to said pump chamber.

24. The unit fuel injector of claim 23 wherein said fuel inlet communicates with said pump chamber and said pump chamber communicates with said valve chamber by means of a pair aligned transverse passages.

25. The unit fuel injector of claim 24 further comprising a one-way check valve in each said passage.

26. The unit fuel injector of claim 24 further comprising a fuel return means having a fuel return path communicating with said three bores to return fuel to a fuel reservoir of the associated engine.

27. The unit fuel injector of claim 23 wherein the fuel inlet means further comprises an angularly adjustable inlet valve for metering the quantity of fuel supplied to said pump chamber.

28. The unit fuel injector of claim 23 further comprising a stroke control means for controlling the stroke of said plunger in said pump chamber.

29. A distributor/governor unit for transferring fuel under low pressure from a fuel reservoir to a unit fuel injector of an associated internal combustion engine, comprising:

a distributor housing having a plurality of angularly spaced radial transfer passages;

a distributor sleeve received in said housing and adapted to be driven by said engine for rotation in said housing, said sleeve having a radial inlet passage and a radial distributor passage alignable with said transfer passages and being connected with a governor means to control the quantity of fuel to said transfer passages;

a transfer pump rotatable with said sleeve to transfer fuel under low pressure from a fuel reservoir to a transfer passage;

a spring biased axially shiftable metering valve positioned interiorly of said rotor and having a valve chamber alignable with said inlet and distributor or passages, said valve being axially shiftable by said governor means to vary the quantity of fuel delivered to said transfer passages.

30. The distributor/governor unit of claim 29 wherein the governor means comprises a flyweight means rotatable with said rotor and radially projectable in accordance with a predetermined rotational speed of the rotor.

31. The distributor/governor unit of claim 30 wherein the metering valve connects to a radial thrust plate said flyweight means being projectable to engage said thrust plate to thereby axially shift said metering valve.

32. The distributor/governor unit of claim 29 wherein the inlet and distributor passages are axially separated, the axial position of the metering valve determining the quantity of fuel supplied from said valve chamber to said distributor passage.

33. The distributor/governor unit of claim 29 wherein the transfer pump is a vane-type pump.

34. The distributor/governor unit of claim 29 further comprising a pump passage leading from said transfer pump to said inlet passage, an electrical shut-off means being interposed in said pump passage.

35. The distributor/governor unit of claim 29 further comprising a pump passage leading from said transfer pump to said inlet passage, a pressure regulator valve being interposed in said passage.

36. The distributor/governor unit of claim 29 wherein the metering valve is biased by a compression spring circumferentially mounted at one end of said valve.

37. The distributor/governor unit of claim 36 wherein the spring is received in a spring seat, the seat being positionable to vary the bias force of the spring against the metering valve.

38. The distributor/governor unit of claim 29 wherein the valve chamber forms a variable restriction with the distributor passage, the metering valve being axially adjustable to vary the quantity of fuel flowing from the valve chamber to the distributor passage.

39. The governor/distributor unit of claim 29 wherein the metering valve is essentially non-rotating.

40. The unit fuel injector of claim 23 wherein said pump plunger is a floating plunger which is axially displaced in accordance with the quantity of fuel supplied to said pump chamber.

41. The unit fuel injector of claim 23 further comprising an inlet metering valve to control the passage of fuel to said pump chamber.

42. The unit fuel injector of claim 23 and further comprising:

a distributor/governor unit for transferring a metered quantity of fuel under a low pressure from a fuel reservoir to the fuel inlet means.

43. The unit fuel injector and distributor/governing unit of claim 42 wherein said distributor/governor unit further comprises, a distributor housing having a plurality of angularly spaced radial transfer passages;

a distributor sleeve received in said housing and adapted to be driven by said engine for rotation in said housing, said sleeve having a radial inlet passage and a radial distributor passage alignable with said transfer passages and being connected with a governor means to control the quantity of fuel to said transfer passages;

a transfer pump rotatable with said sleeve to transfer fuel under low pressure from a fuel reservoir to a transfer passage; and a spring biased axially shiftable metering valve positioned interiorly of said rotor and having a valve chamber alignable with said inlet and distributor passages, said valve being axially shiftable by said governor means to vary the quantity of fuel delivered to said transfer passages.

* * * * *